United States Patent [19]

Beyl

[11] 4,278,269

[45] Jul. 14, 1981

[54] COMBINED SKI BOOT AND SAFETY BINDING

[75] Inventor: Jean J. A. Beyl, Nevers, France

[73] Assignee: Look, Nevers, France

[21] Appl. No.: 57,081

[22] Filed: Jul. 12, 1979

[30] Foreign Application Priority Data

Jul. 13, 1978 [FR] France ..... 78 21053

[51] Int. Cl.[3] ..... A63C 9/08

[52] U.S. Cl. ..... 280/613; 280/605

[58] Field of Search ..... 280/613, 616, 617, 618, 280/620, 611, 636, 624; 36/117

[56] References Cited

U.S. PATENT DOCUMENTS

| | | | |
|---|---|---|---|
| 3,865,388 | 2/1975 | Haldeman | 280/613 |
| 3,899,190 | 8/1975 | Schweizer et al. | 280/613 |
| 3,931,980 | 1/1976 | Marker | 280/613 |
| 3,931,982 | 1/1976 | Kubelka | 280/613 |
| 3,964,758 | 6/1976 | Kent | 280/613 |
| 4,182,524 | 1/1980 | Beyl | 280/624 |

*Primary Examiner*—David M. Mitchell

*Attorney, Agent, or Firm*—Bierman & Bierman

[57] ABSTRACT

This combined ski boot and safety binding comprising a recessed boot receiving a binding case is adapted releasably to cooperate with a complementary member fastened to the ski, the case comprising pistons responsive to resilient return springs, the pistons being provided with transverse rods engaging cam contours formed on upstanding lateral lugs rigid with the complementary member; the boot is provided with a pivot member formed with opposite flat faces adapted to actuate the pistons when the boot is lifted and/or rotated as a consequence of a forward or backward fall, or in case of abnormal torsion stress, so as to release the boot and the case from the complementary member.

14 Claims, 20 Drawing Figures

COMBINED SKI BOOT AND SAFETY BINDING

BACKGROUND OF THE INVENTION

1. Field of the Invention

The present invention relates in general to ski boots and safety ski bindings, and has specific reference to a combined ski boot and safety binding comprising more particularly a ski boot and a safety ski binding assembly in which the binding is set or embedded in the boot sole and capable of releasably retaining the boot on the ski by cooperating with a complementary member secured to the top surface of the ski.

2. Description of the Prior Art

Ski boot and binding assemblies of this character are already known in the art, notably through the U.S. Pat. No. 3,899,190.

However, these known arrangements are objectionable for they are attended by the following inconveniences:

Under the boot sole there is provided either a recess or a relief portion adapted to cooperate with the complementary member carried by the ski. If a recess is provided, snow and mud may tend to accumulate therein when walking, and thus interfere with the proper operation of the safety release means. In the case of a relief portion, the skier's walk becomes uneasy.

Besides, the sole must be provided with non-skid notches or studs to permit walking. Yet, on the other hand, the coefficient of friction between the boot and the ski should be relatively low so that the boot can easily be released under torsion stress. These two contradictory requirements constitute a problem hitherto unsolved in the present state of the art.

The known assemblies of the type discussed herein do not provide any interaction between on the one hand the means retaining the boot against an upward movement in case of forward or backward fall, and on the other hand the means retaining the boot against rotation in case of a torsion stress. Now this interaction is extremely desirable from the point of view of safety. In fact, in case of complex fall, i.e. a fall combining torsion stress with a tractive stress, the skier's tibia is considerably more vulnerable than in case of a simple fall. Thus, when the skier is in a position of want of balance either forwards or backwards, his tibia may break under a lateral stress weaker than that required for breaking his tibia when he is in a normal position.

SUMMARY OF THE INVENTION

It is the primary object of the present invention to provide a combined ski boot and safety binding which is substantially free of the inconveniences set forth hereinabove.

To this end, and according to this invention, the boot sole has formed therein a recess so dimensioned that a flat and elongated safety binding case can be fitted into the recess, this case being mounted for rotation about a pivot member rigid with the boot sole and projecting into the recess at right angles to the top surface of the ski.

The safety binding case includes boot retaining means on each lateral side thereof for engaging a complementary member secured to the ski to normally hold the case on the ski, and a resilient means is provided within the case for insuring engagement of the retaining means and the complementary member and acting on the pivot member to urge the boot to its normal position relative to the case on the ski, such that any rotational movement of the boot and the pivot member which tends to move the boot away from its normal position will release the boot retaining means from its normal operative position in relation to the complementary member rigid with the ski, and conversely that in case of a forward or backward fall, a movement of the retaining means will release the action of the resilient means on the pivot member and enable the pivot member and the boot to rotate on the ski, whereby in each case the boot and the case may be released from the complementary member.

Under these conditions, the present invention provides a lateral retaining action between the boot and the ski, by virtue of the complementary member rigid with the ski and provided with suitable retaining members adapted to cooperate with the anchoring means of the safety ski binding proper. With this arrangement, the presence of male or female members under the sole is safely avoided, thus precluding any risk of accumulating snow or ice in the recess, or any interference with the skier's walk due to the presence of male elements under the sole.

Moreover, in case of torsion stress, the case remains stationary in relation to the ski, so that the presence of anti-skid studs or grooves under the sole will not interfere with the torsional release.

According to a first form of embodiment of the assembly constituting the present invention, the case-supporting pivot member comprises two flat faces directed to the front and to the rear, respectively, and a pair of pistons slidably mounted in the case on either side of the pivot member and resiliently urged towards said flat faces, respectively, by the above-mentioned resilient means, at least one of said pistons being provided with a transverse rod of which the end portions, constituting anchorage means, extend through elongated holes formed in the lateral walls of the case and are resiliently urged against lateral, suitably shaped retaining lugs forming an integral part of the complementary member secured to the ski.

Thus, when the boot and the pivot member are rotated the two pistons are moved away from the corresponding flat faces and the ends of the rod or rods are released from the retaining lugs, and conversely a movement of the ends of the retaining rod or rods in relation to the retaining lugs as a consequence of a forward or backward fall is attended by a movement of the pistons away from their bearing flat faces, thus releasing the boot under a torsion stress.

The construction of this invention will thus provide an interaction between the boot retaining means in a vertical plane, and the retaining means operative in case of torsion, and this feature, as already explained in the foregoing, is particularly important from the point of view of the skier's safety which is improved considerably with the combined boot and binding of the invention.

According to a specific feature characterising this invention, the lugs rigid with the complementary member secured to the ski are substantially mushroom-shaped and provide for each lug a pair of shaped cam contours adapted to retain the corresponding ends of the boot retaining rods which are preferably provided with rollers. Thus, in case of forward or backward fall, the cam contours formed on the retaining lugs move the rods away from each other and correlatively the two pistons are also moved away from the pivot member, thus releasing the boot in case of torsion stress.

According to another feature characterising this invention, the axis of the pivot member is either substantially coincident with the center of the boot, or substantially aligned with the tibia axis.

Disposing the pivot axis centrally of the boot affords a proper positioning on the ski indpendently of the boot size, but on the other hand the skier's safety is improved if the pivot axis lies on the tibia axis, that is, the natural pivot axis of the skier's leg.

Other features and advantages of this invention will appear as the following description proceeds with reference to the attached drawings illustrating diagrammatically by way of example various forms of embodiment of the combined ski boot and safety ski binding of this invention.

DESCRIPTION OF THE PREFERRED EMBODIMENTS

Figure 1:
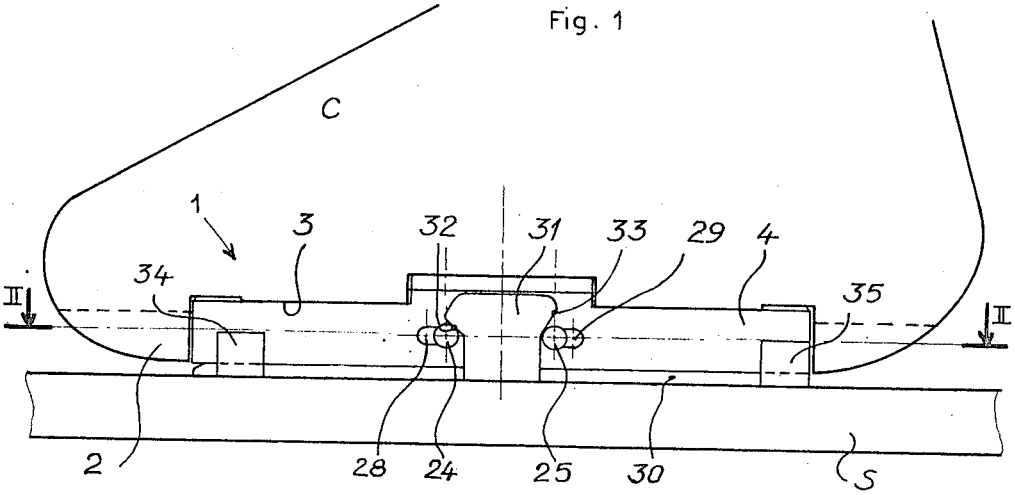
FIG. 1 is a side elevational view showing a first form of embodiment of the combined boot and binding arrangement of this invention.

Referring first to FIGS. 1 to 9 of the drawings, the assembly illustrated therein comprises a ski boot C and a safety binding 1 fitted in the sole 2 of boot C and adapted releasably to retain the boot C on a ski S by cooperating with a complementary member 30 (see FIGS. 8 and 9) secured to the top surface of the ski.

According to this invention, the sole 2 of boot C has formed therein a recess 3 dimensioned for receiving a flat, elongated case 4 of substantially parallelipipedic configuration, this case being adapted to rotate about a pivot member 5. This pivot member is rigid with the sole 2 and projects into the case 3 at right angles to the top surface of the ski S.

On the other hand, the case 4 encloses resilient means associated with means for retaining the ski boot C laterally on the complementary member 3 and constantly urging the boot C to its normal position on the ski, both against torsion stress and in case of forward or backward fall.

The pivot member 5 of this exemplary form of embodiment is fastened to the sole 2 by setting or riveting its upper portion 5*c* (FIG. 3) on a plate 6 secured to a central cavity 7 of the recess 3 by mean of screws 8. Thus, the pivot member 5 is positioned centrally of the boot C on the center line X—X of the boot, at right angles to the ski S.

This pivot member 5 has formed on its front and rear sides, respectively, a pair of flat faces 5*a* and 5*b* against which corresponding pistons 9, 11 slidably mounted in the case 4 on either side of pivot member 5 are resiliently urged by the aforesaid resilient means. Each piston 9, 11 consists of a substantially U-shaped strap having its central portion 9*a*, 11*a* resiliently urged against the corresponding flat faces 5*a*, 5*b* by a corresponding set of springs 12, 13, respectively, constituting the aforesaid resilient means. Each set of springs 12, 13 comprises a plurality of coil compression springs, four in the example illustrated, as shown at 12*a*, 12*b* . . . 13*a*, 13*b* . . . housed within the relevant piston 9, 11, respectively, and reacting against a transverse end wall 14, 15 of case 4.

The springs 12*a*, . . . and 13*a*, . . . engage the ends 14, 15 of case 4 through the medium of transverse angle bars 16, 17 abuting against central sockets 18, 19 projecting from the transverse end walls 14, 15 within the case 4, said sockets 18, 19 receiving in their tapped central bores corresponding screws 21, 22, whereby the longitudinal position of the said transverse angle bars 16, 17 can be adjusted. This position determines the resistance of the resilient means 12, 13.

The ends of the return springs 12*a*, . . . 13*a* . . . opposite the transverse angle bars 16, 17 surround coaxial guide studs 23 rigid with the transverse arms 9*a*, 11*a* of pistons 9, 11, respectively.

The pistons 9, 11 are each provided with a transverse rod 24, 25 and the rods carry at their ends rollers 26, 27, respectively. The ends of rods 24, 25 extend through elongated holes 28, 29 formed in the lateral walls of case 4. Each rod will thus pass through two elongated holes 28 or 29 having their major axes parallel to the top surface of ski S, so as to afford a certain degree of free play for the rods 24 and 25. The ends of these rods 24, 25 are pressed resiliently against a pair of suitably shaped upstanding lateral lugs 31 formed integrally with the complementary member 30 secured to the top surface of the ski. The lugs 31 are substantially mushroom-shaped so as to provide for each lug a pair of cam contours 32, 33 adapted to retain the relevant ends of the holding rods 24 and 25. The cam contours 32, 33 are opposed to each other so that the ends of rods 24, 25 are held in resilient engagement with these cam contours 32, 33.

Figure 8:
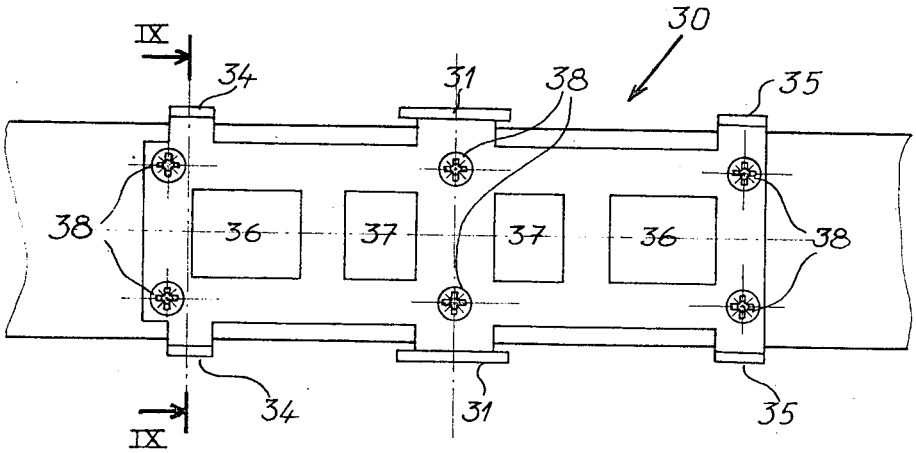
FIG. 8 is a plane view from above showing the complementary member secured to the ski and adapted to receive the case fitted in the boot sole.
Figure 9:
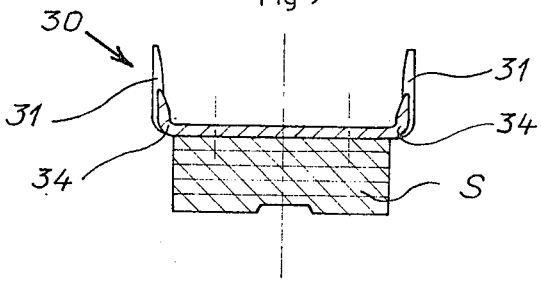
FIG. 9 is a cross section taken along the line IX—IX of FIG. 8.

The complementary member 30 supporting the lugs 31 is substantially cup-shaped with a U-shaped cross sectional contour, as shown in FIGS. 8 and 9; the lugs 31 are disposed intermediate the ends of this member 30, on the longer sides thereof, and extend at right angles to the ski S. The complementary member 30 further comprises one or a plurality of lateral upstanding end lugs 34, 35 acting as stop means for holding the case 4 in its normal position on the ski.

In the example illustrated, the complementary member 30 comprises a pair of front end lugs 34 and a pair of rear end lugs 35. On the other hand, several notches or apertures 36, 37 are formed through the bottom of the cup-shaped member 30 in order to reduce its weight, the member 30 being fastened to the ski S by means of screws 38.

Figure 2:
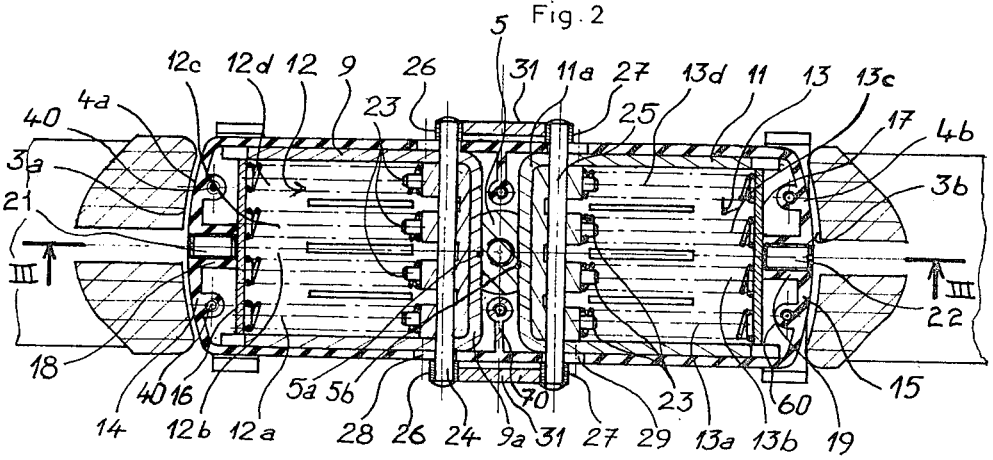
FIG. 2 is a horizontal section taken along the line II—II of FIG. 1.
Figure 3:
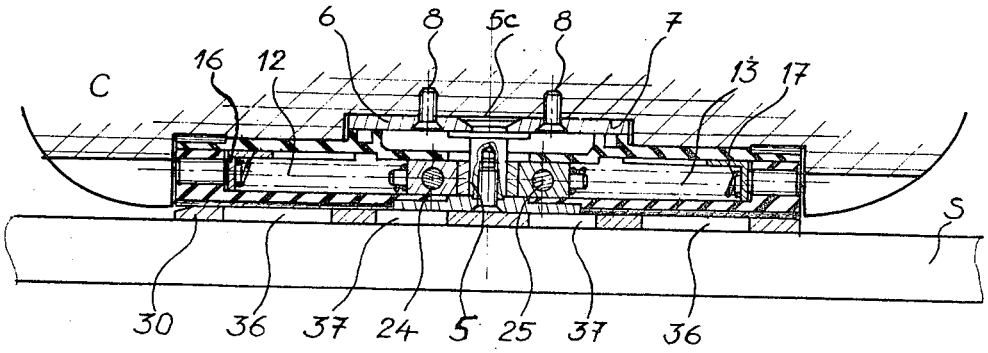
FIG. 3 is a longitudinal vertical section taken along the line III—III of FIG. 2.
Figure 4:
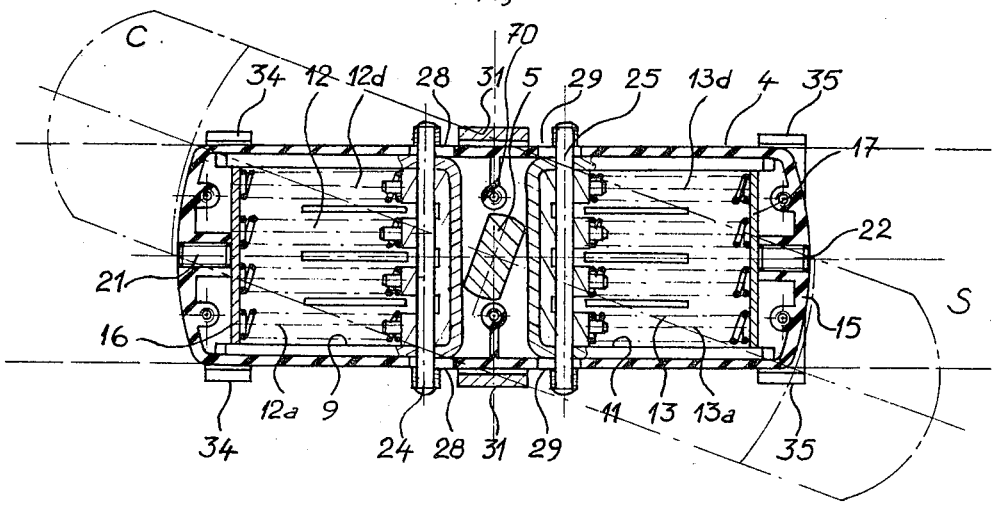
FIG. 4 is a view similar to FIG. 2, showing the condition of the safety binding when a torsion movement of the boot takes place.

The front and rear edges 4*a*, 4*b* of case 4, and the relevant transverse walls 3*a*, 3*b* of case 4, have conjugate curvatures centered to the axis of pivot member 5, as clearly shown notably in FIGS. 2 and 4, so that the boot C can rotate in relation to the case 4. The latter further comprises several inner bosses 40, 60, 70 formed with tapped holes for engagement by screws (not shown) for fixing a case bottom closing plate.

Figure 5:
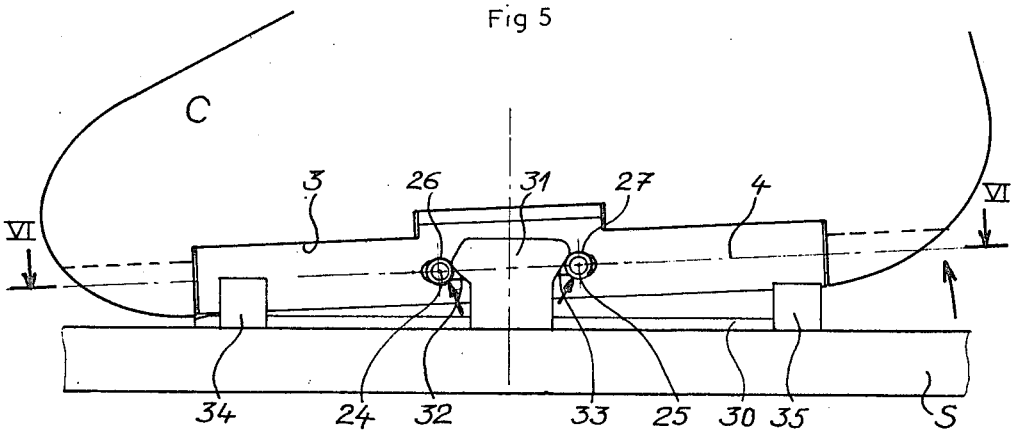
FIG. 5 is a view similar to FIG. 1 showing the positions of the boot and of the retaining means thereof at the beginning of a forward fall.
Figure 6:
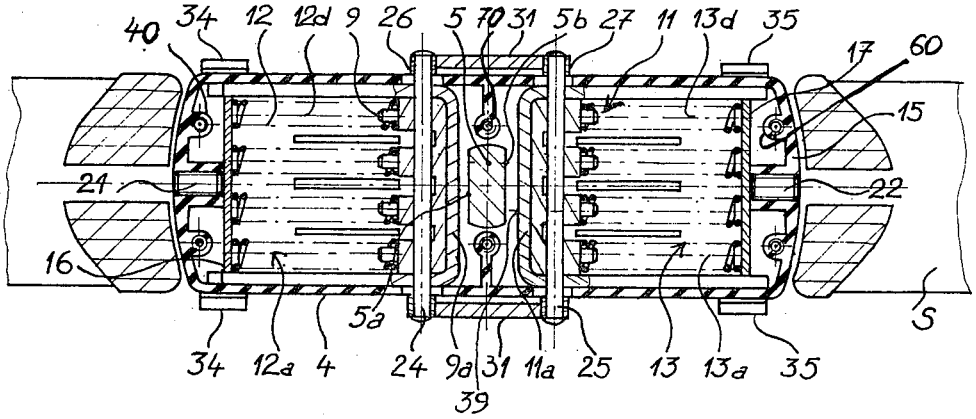
FIG. 6 is a view similar to FIG. 2 showing the positions of the component elements of the binding at the beginning of the forward fall illustrated in FIG. 5.

The technical and advantageous features characterising the above described combined boot and safety binding are as follows:

Firstly, the mutual engagement between the boot C and the ski S takes place laterally, as a consequence of the cooperation between the ends of rods 24, 25 provided with rollers 26, 27, and the retaining lugs 31 on which shaped cam contours 32, 33 are formed. The case 4 is centered in relation to the pivot member 5 and consequently to the boot C by the piston 9, 11 having their faces 9*a*, 11*a* resiliently urged against the corresponding flat faces 5*a*, 5*b* of pivot member 5 by the resilient return means 12, 13. In case of forward fall of the skier, as illustrated in FIGS. 5 and 6, or in case of backward fall, the retaining rods 24,25 are moved upwards and remain in engagement with the divergent cam contours 32, 33 of lugs 31, so as to be pushed back on either side. Correlatively, the rods 24, 25 move the pistons 9, 11 away from flat faces 5*a*, 5*b* as shown in FIG. 6, thus releasing the boot C from the ski through a torsion movement.

Inversely, in case of torsion stress, as shown in FIG. 4, the pivot member 5 rigid with the boot C rotates about the axis X—X while the case 4 remains centered on the ski since it is engaged between the abutment-forming lugs 34, 35 and also between the retaining lugs 31. Thus, the faces 9*a*, 11*a* of pistons 9, 11 are moved away from pivot member 5, and the retaining rods 24, 25 are separated from the retaining lugs 31 and the ski can be lifted off the ski.

Therefore, a movement of rotation of the boot C tending to move same away from its normal position will be attended by a slackening of the forces tending to hold the boot retaining means 24, 25 in their active position in relation to the lugs 30; conversely, in case of forward or backward fall, the movement of retaining means 24, 25 is attended by a reduction in the force tending to hold the boot C against rotation on the ski S.

Thus, an interaction is obtained between the means retaining the boot against torsion movement and the means retaining the boot in case of forward or backward fall, a feature particularly advantageous since it will reduce considerably the risk of injury to the skier in case of complex fall.

Figure 7:
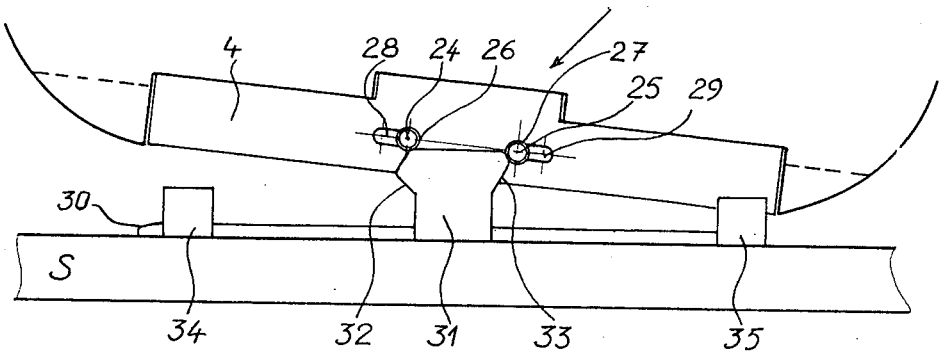
FIG. 7 is a diagrammatic elevational view showing the boot with its retaining means when the skier begins to put on the boot.

As illustrated in FIG. 7, the boot C is fitted to the ski by applying the boot to the complementary member 30 so that the ends of rods 24, 25 overlie the lugs 31 (arrow F). The rods are firstly pushed apart and then contracted so as to engage the cam contours 32, 33 due to the pressure exerted by the resilient means 12, 13.

Figure 10:
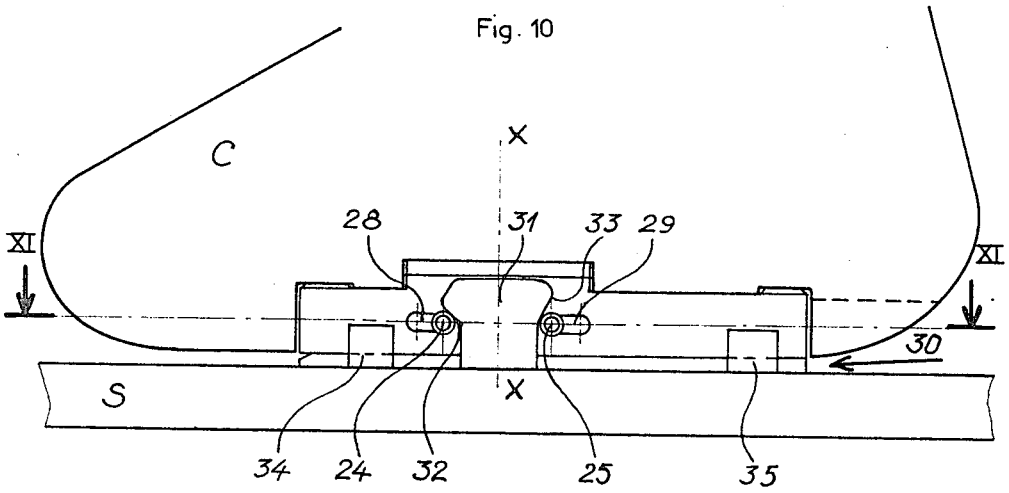
FIG. 10 is a side elevational view showing a second form of embodiment of the combined ski boot and binding according to this invention.
Figure 11:
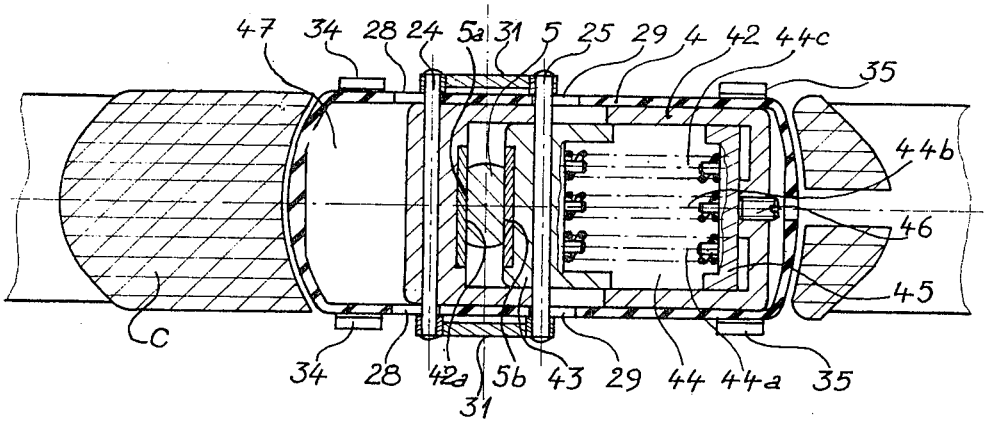
FIG. 11 is a horizontal section taken along the line XI—XI of FIG. 10, showing the boot in its normal position on the ski.
Figure 12:
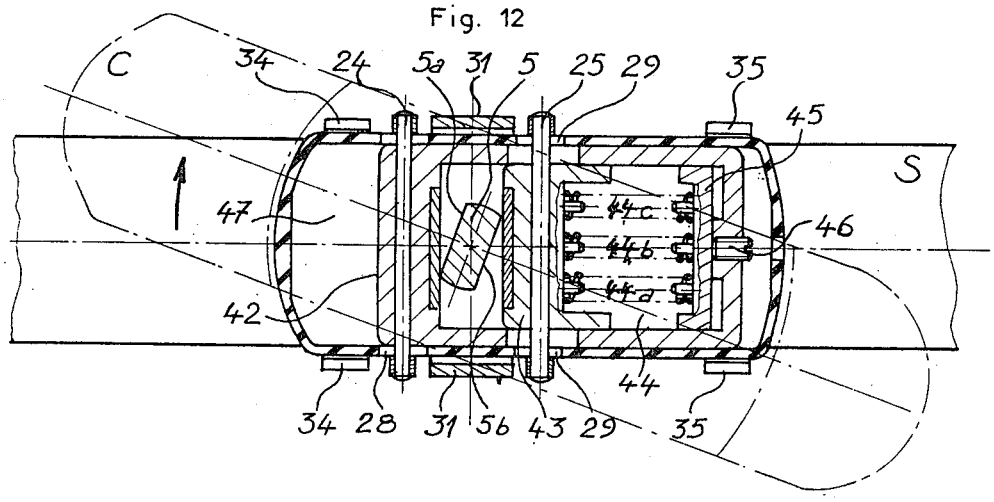
FIG. 12 is a sectional view similar to FIG. 11, showing the positions of the component elements of the safety ski binding during a release caused by a torsion stress.

The modified form of embodiment illustrated in FIGS. 10 to 12 differs from the preceding one in that the first piston 42 consists of a rectangular frame of which a transverse inner face 42*a* is adapted to engage the corresponding flat face 5*a* of pivot member 5. The latter is housed inside the frame 42 which can slide longitudinally in case 4, and the second piston 43 is slidably mounted in frame 42 so that the pivot member 5 be interposed between the two pistons 42 and 43.

As in the preceding form of embodiment, each piston carries a transverse rod 24, 25 cooperating with the lugs 31.

However, the form of embodiment shown in FIGS. 10 to 12 also differs from the preceding one in that, in the example illustrated, it comprises a single resilient assembly 44 consisting of three coil compression springs 44*a*, 44*b* and 44*c* disposed inside the frame 42 and reacting against a cross wall of this frame so as to urge the second piston 32 against the corresponding flat face 5*b* of pivot member 5.

In this modified arrangement, the resilient means or assembly 44 urges alone and simultaneously the two pistons 42 and 43 against the two flat faces of pivot member 5. This resilient means reacts against a cross member 45 fitted in abuting relationship against the transverse wall of case 4, a screw 46 being engaged through this transverse wall to permit the adjustment of the longitudinal position of cross member 45 in said frame 42. As in the preceding form of embodiment, adjusting this longitudinal position will also adjust the resistance of the binding.

This form of embodiment is particularly advantageous in that the resilient means is reduced to a single set of resilient return members controlling the retaining means, instead of two sets in the form of embodiment shown in FIGS. 1 to 9. Thus, the number of component elements necessary for assembling the ski binding is reduced considerably, its manufacture is simplified and more economical, and the dimensions of the front portion of case 4 is reduced appreciably, notably in the longitudinal direction.

FIG. 12 illustrates the movement of pistons 42 and 43 on either side of pivot member 5 when the latter is caused to rotate about its axis with the boot C.

Figure 13:
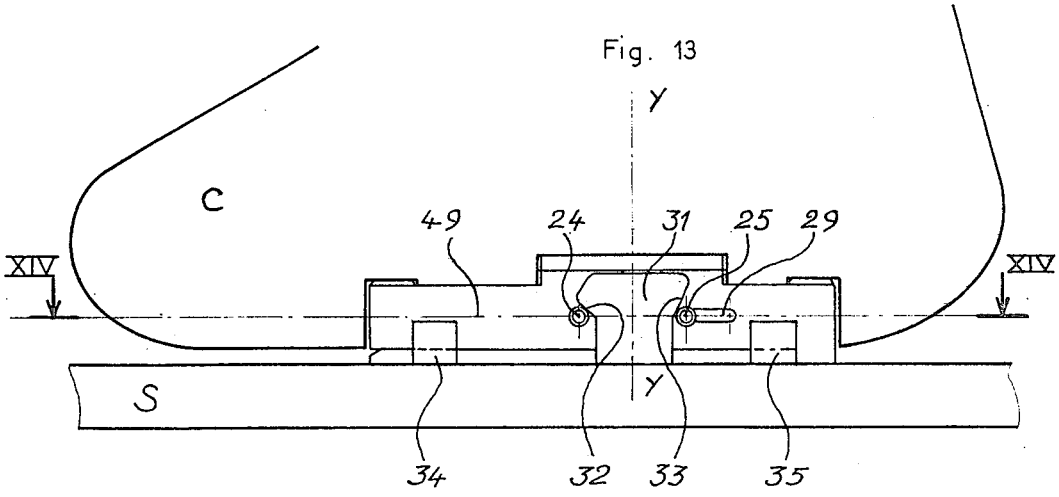
FIG. 13 is a side elevational view showing a third form of embodiment of the combined ski boot and binding according to this invention.
Figure 14:
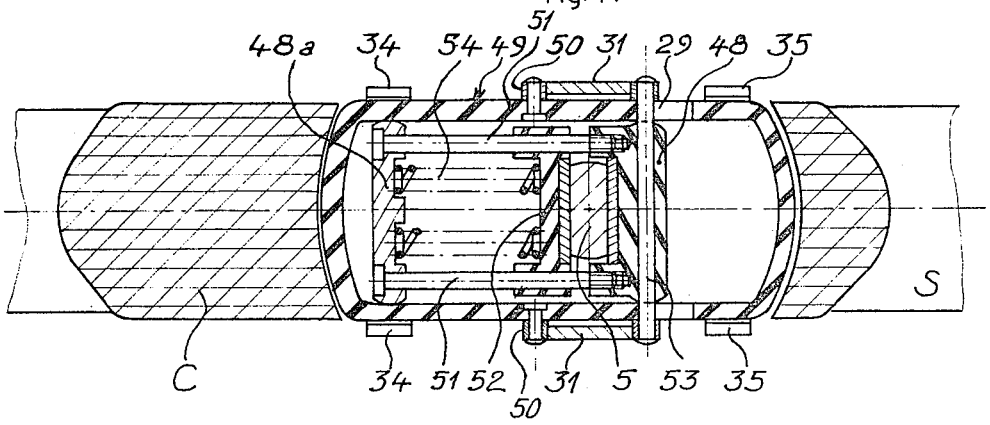
FIG. 14 is a longitudinal section taken along the line XIV—XIV of FIG. 13.
Figure 15:
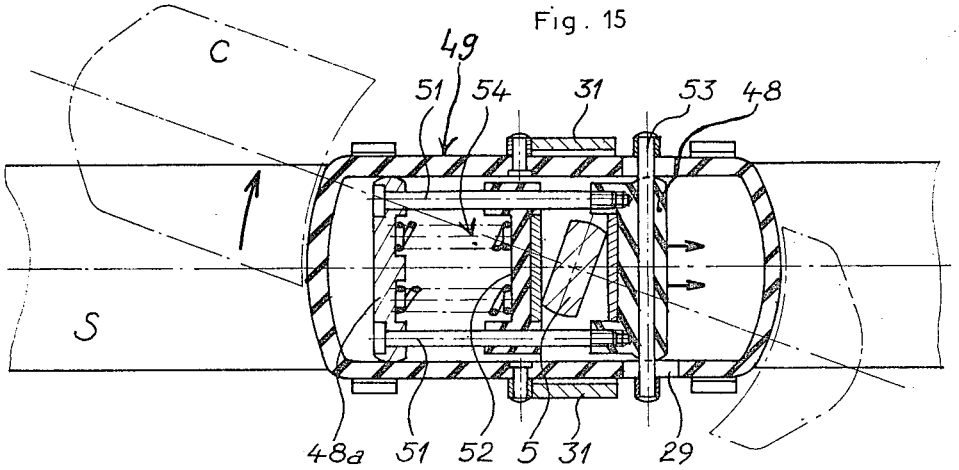
FIG. 15 is a sectional view similar to FIG. 14, showing the condition of the component elements of the ski binding during a rotational movement of the boot in relation to the ski.

In the third form of embodiment illustrated in FIGS. 13 to 15, the pivot member 5 lies on the axis Y—Y of the skier's tibia, in order to improve the binding safety.

On the other hand, the first piston 48 consists of a rectangular frame adapted to slide longitudinally in the case 49. The two small sides of this frame 48 are interconnected by parallel longitudinal tie-rods 51 on which the second piston 52 is slidably mounted, the pivot member 5 being interposed between the two pistons 48 and 52. However, only piston 48 carries a transverse retaining rod 53 engaging the retaining lugs 31, the rollers 50 of the rod thus eliminated being secured to the case 49. In fact, the piston 52 has no transverse rod and is resiliently urged for bearing engagement with the pivot member 5, like the first piston 48, by a single resilient device 54 reacting on the one hand against the second piston 52 and on the other hand against the opposite small side 48*a* of frame 48. In the example illustrated, this device 54 comprises only two springs.

When the boot C and pivot member 5 are caused to rotate about the tibia axis Y—Y, as shown in FIG. 15, the pivot member 5 moves the pistons 48 and 52 apart, so that the rod 53 is also moved away from the retaining lugs 31, thus releasing the boot in a vertical plane in case of forward or backward fall. Conversely, a forward or backward fall moves the rod 53 away from lugs 31 and therefore piston 48 from pivot member 5. In contrast thereto, the second piston 52 remains pressed by the resilient force of springs 54 against the corresponding flat face of pivot member 5, since it has no retaining rod, so that a residual torsion retaining torque is maintained. This arrangement prevents the torsion release means from being released abruptly, and does only reduce considerably its force, which is an additional advantage from the point of view of the skier's safety.

The complete boot and binding assembly illustrated in FIGS. 16 to 20 is similar to that of FIGS. 1 to 9, but it comprises a complementary device for removing the ski boot from the ski, which constitutes at the same time a braking device, as illustrated in general by the reference numeral 55.

This device 55 comprises in combination a bent two-armed lever 56 having one arm 56*a* engaged under the heel of boot C when the latter is normally positioned on the ski, and a brake 57 comprising in turn two lateral braking arms 57*a* interconnected by a bow 58. The latter is normally enclosed in a cavity formed under the bent, shoe-engaging portion 56*a* of lever 56. Return means in the form of a pair of lateral spring-wires 59 surrounding the two ends of bow 58 on either side of lever 56 constantly urge the brake 57 to its operative or braking position while pressing the bow 58 against the bent portion 56*a* of lever 56. The latter is pivoted about a transverse axis 62 passing through two bearing members 61 supporting the lever 56 and secured to the top surface of the ski S.

Figure 16:
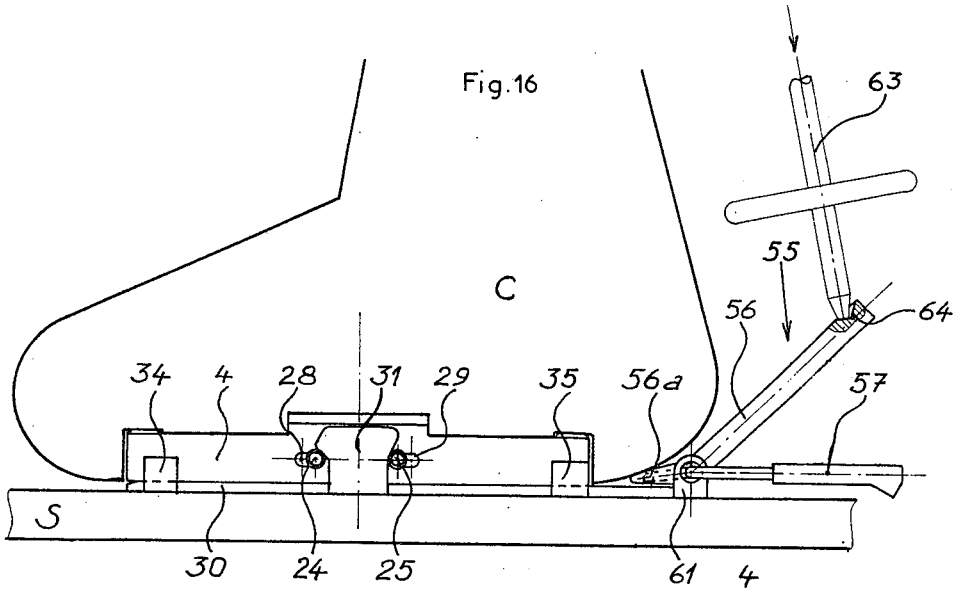
FIG. 16 is a side elevational view showing a combined boot and binding similar to the one shown in FIGS. 1 to 7, but provided with a device acting both as a means for putting on the ski boot and as a brake.
Figure 17:
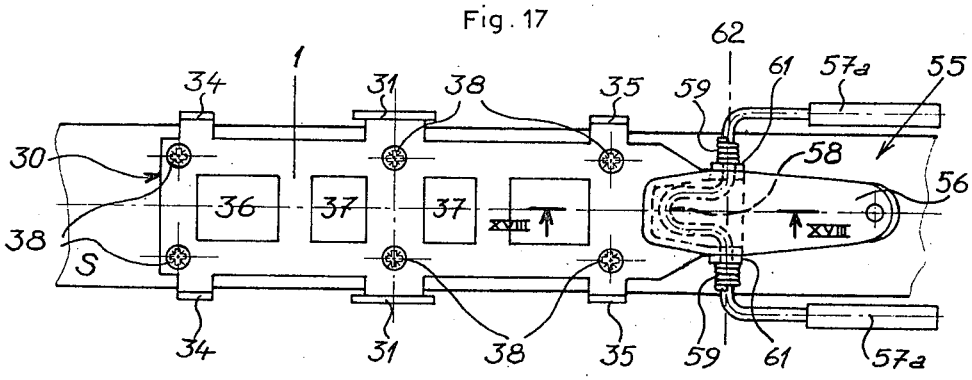
FIG. 17 is a plane view from above of the boot fitting device shown in FIG. 16, together with the ski-binding receiving member rigid with the ski.
Figure 18:
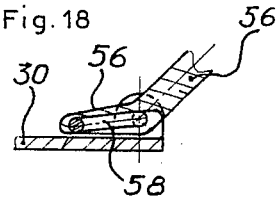
FIG. 18 is a fragmentary view taken along the line XVIII—XVIII of FIG. 17, showing on a larger scale a detail of the device for facilitating the fitting of the boot.
Figure 19:
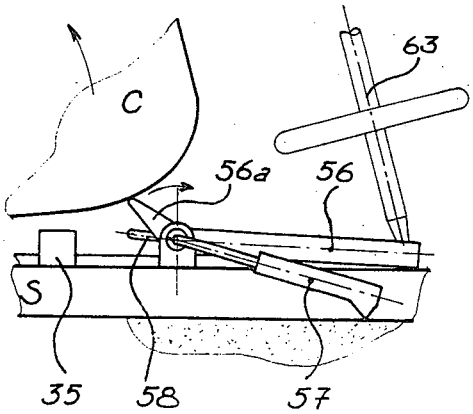
FIG. 19 is a fragmentary side elevational view showing the device of FIG. 18 in the position permitting the release of the ski boot, the arms of the braking device being in their inoperative positions.

The ski boot C is removed by simply causing the lever 56 to pivot in the clockwise direction (as seen in FIGS. 16 and 19), for example by exerting a pressure on its upper end by means of a stick 63, the upper end of lever 56 having a small cavity 64 formed therein for receiving the tip of the stick 63. The opposite end portion 56*a* of lever 56 will thus lift the boot heel until the boot is released from the binding (FIG. 19). At the same time, the brake 57 resiliently urged by springs 59 is allowed to pivot to its operative position (FIG. 20).

Figure 20:
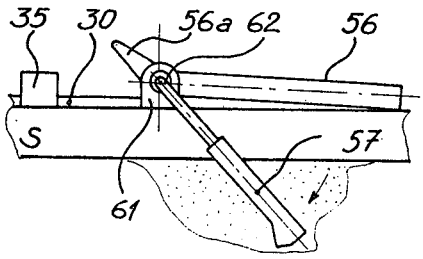
FIG. 20 is a view similar to FIG. 19, showing the boot-fitting and braking device after the removal of the boot, the brake being in its operative position.

When the boot is detached from the ski as a consequence of the release of the safety binding, the springs 59 cause the pivotal movement in the clockwise direction both of lever 56 and brake 57 to the positions shown in FIG. 20. When the skier refits the boots to the ski, the pressure exerted by the boot on the bent front end 56*a* of lever 56 causes the latter and the brake 57 to rotate in the counterclockwise direction about the horizontal axis 62.

Of course, this invention should not be construed as being strictly limited by the specific forms of embodiment shown and described herein, since many modifications and changes may be brought thereto without departing from the basic principles of the invention as set forth in the appended claims. Thus, the number of springs incorporated in the resilient means 12, 13, 44, 54 may vary. The anti-skid studs mentioned in the preamble of the specification are not shown in the drawings in order not to make the latter unduly complicated; now these studs could have been formed not only under the case 4 but also under the portions of sole 2 located ahead or behind the case, for these portions are not in direct engagement with the ski. Moreover, if desired the cam contours and flat faces of pivot member 5 may be replaced by hollow impressions adapted to cooperate with pistons having a complementary shape or configuration.

What is claimed as new is:

1. An assembly comprising a combined ski boot and a safety ski binding embedded in the boot sole and adapted to releasably retain the boot on the ski by cooperating with a complementary member secured to the top surface of a ski, wherein the boot sole has formed therein a recess dimensioned for receiving a flat elonagated case rotatably mounted on a pivot member rigid with said boot sole and projecting from the bottom of said recess at right angles to the top surface of the ski, said case including boot retaining means on each lateral side thereof for engaging said complementary member to normally hold said case on the ski, resilient means within said case for insuring engagement of said retaining means and said complementary member and acting on said pivot member to urge said boot to its normal position relative to said case on the ski, such that any rotational movement of said boot and said pivot member which tends to move said boot away from its normal position will release said boot retaining means from its normal operative position in relation to said complementary member rigid with the ski, and conversely that in case of a forward or backward fall, a movement of said retaining means will release the action of said resilient means on said pivot member and enable said pivot member and said boot to rotate on the ski, whereby in each case said boot and said case may be released from said complementary member.

2. A combined ski boot and safety binding as claimed in claim 1, wherein said case-supporting pivot member has formed thereon two opposite flat faces, namely a front face and a rear face, against which two pistons slidably mounted in said case on either side of said pivot member are resiliently urged by said resilient means, at least one of said pistons being provided with a transverse rod of which the ends, constituting boot retaining means, extend through elongated holes formed in the lateral walls of said case and are pressed resiliently against suitably shaped lateral lugs rigid with said complementary member rigid in turn with the ski, whereby a rotational movement of said boot and pivot member is attended by a movement of said pair of pistons away from the relevant bearing flat faces so as to release the corresponding rod from said retaining lugs, and conversely a movement of the ends of said rod in relation to said retaining lugs as a consequence of a forward or backward fall is attended by a movement of said pistons away from the relevant bearing flat faces so as to release said boot with a torsion movement.

3. A combined ski boot and safety binding as claimed in claim 2, wherein said pistons consist of substantially U-shaped straps of which at least the transverse arms are pushed resiliently against the relevant flat face of said pivot member by a spring housed within the piston and reacting against a transverse wall of said case.

4. A combined ski boot and safety binding as claimed in claim 3, wherein each of said pistons includes a said rod, and said lugs of said complementary member secured to the ski have a substantially mushroom configuration providing for each lug a pair of cam contours adapted to retain the corresponding ends of said boot retaining rods.

5. A combined ski boot and safety binding as claimed in claim 2, wherein said first piston consists of a rectangular frame slidably mounted for longitudinal movement in said case, said pivot member being housed within said frame, the second piston being slidably mounted in turn in said frame, whereby said pivot member is interposed between the two pistons, a single resilient means, consisting of at least one spring, being disposed inside said frame so as to react against a transverse wall thereof and to urge said second piston against the relevant flat face of said pivot member, and said first piston against the other flat face of said pivot member.

6. A combined ski boot and safety binding as claimed in claim 5, wherein said resilient means bears against said frame through the medium of a cross member disposed internally of said frame, said cross member being adjustable in the longitudinal direction of the device by means of a screw engaging a tapped hole formed in the transverse wall of said sliding frame.

7. A combined ski boot and safety binding as claimed in claim 2, wherein said first piston consists of a rectangular frame slidably mounted in said case and having its two small sides interconnected by longitudinal tie-rods on which said second piston is slidably mounted, said pivot member being interposed between said two pistons, a single resilient means consisting of a least one spring being disposed between said second piston and the registering small side of said sliding frame.

8. A combined ski boot and safety binding as claimed in claim 7, wherein said pivot member is secured substantially at the middle point of the ski boot.

9. A combined ski boot and safety binding as claimed in claim 7, wherein said pivot member is secured to the boot substantially in alignment with the axis of a skier's tibia.

10. A combined ski boot and safety binding as claimed in claim 8 or 9, wherein said complementary member secured to the ski is cup-shaped with an U-shaped cross section, and provided with lugs constituting abutment means for holding said case in its normal position along the ski axis.

11. A combined ski boot and safety binding as claimed in claim 10, wherein a device for removing the ski boot and braking the ski is provided, which comprises in combination a bent lever fulcrumed to a transverse pivot axis and formed with an arm engaging the heel of the boot from beneath when the boot bears normally on the ski, a brake comprising a pair of lateral braking arms interconnected by a bow disposed under the end of the lever arm engaged under the heel, and resilient means constantly urging the brake to its braking position while pressing the bow thereof against said bent lever, so as to urge said bent lever to a position in which it is pressed against the top surface of the ski.

12. A combined ski boot and safety binding as claimed in claim 11, wherein the front and rear edges of the binding case as well as the cooperating transverse walls of the recess formed in the sole have conjugate curvatures centered to the axis of said pivot member to permit the rotation of the boot in relation to the case, the latter being retained on said complementary member rigid with the ski.

13. A combined ski boot and safety binding as claimed in claim 12, wherein each piston carries a transverse rod adapted to cooperate with said retaining lugs.

14. A combined ski boot and safety binding as claimed in claim 12, wherein only the first piston carries a transverse rod having its ends anchored to the lateral lugs of said complementary member secured to the ski.

* * * * *